US012193562B2

(12) United States Patent
Malone

(10) Patent No.: US 12,193,562 B2
(45) Date of Patent: Jan. 14, 2025

(54) BEVERAGE CARRIER

(71) Applicant: Matt Malone, Broomfield, CO (US)

(72) Inventor: Matt Malone, Broomfield, CO (US)

( * ) Notice: Subject to any disclaimer, the term of this patent is extended or adjusted under 35 U.S.C. 154(b) by 203 days.

(21) Appl. No.: 18/085,754

(22) Filed: Dec. 21, 2022

(65) Prior Publication Data

US 2023/0122446 A1 Apr. 20, 2023

Related U.S. Application Data

(63) Continuation of application No. PCT/US2021/039166, filed on Jun. 25, 2021.

(60) Provisional application No. 63/044,744, filed on Jun. 26, 2020.

(51) Int. Cl.
*A45F 3/14* (2006.01)
*A45F 5/00* (2006.01)

(52) U.S. Cl.
CPC ..... *A45F 5/00* (2013.01); *A45F 2005/002* (2013.01); *A45F 2005/006* (2013.01); *A45F 2200/0583* (2013.01)

(58) Field of Classification Search
CPC ..... A45F 3/14; A45F 2200/0583; A45F 3/16; A47G 23/0216; B65D 81/38; A62B 35/0043; A62B 35/0081
See application file for complete search history.

(56) References Cited

U.S. PATENT DOCUMENTS 5,577,647 A * 11/1996 Pittarelli ..... A45F 3/16 224/148.1
5,582,337 A * 12/1996 McPherson ..... A45F 3/14 224/663
8,066,148 B2 * 11/2011 Garahan ..... A45F 5/02 220/737
10,154,724 B2 * 12/2018 Boino ..... A45F 5/00
2007/0221693 A1 * 9/2007 Moore ..... A45F 3/16 224/236
2010/0078451 A1 4/2010 Mount
2015/0265083 A1 9/2015 Myers

FOREIGN PATENT DOCUMENTS

WO 2014083453 A1 6/2014

OTHER PUBLICATIONS

PCT/US2021/039166 International Search Report and Written Opinion dated Sep. 30, 2021 (8 pages).

* cited by examiner

*Primary Examiner* — Adam J Waggenspack
(74) *Attorney, Agent, or Firm* — Michael Best & Friedrich LLP

(57) ABSTRACT

A beverage carrier for personal transport of a contained beverage includes a beverage holder having a sleeve configured to support a beverage container and a splash guard coupled to the sleeve and positionable from a closed to an open position. A motion subsystem includes a motion block having a housing having a wall, at least two spaced apart static bearings protruding from the wall, and a strap extension protruding from the wall. A first strap is configured to couple the sleeve to the motion subsystem via the strap extension. A second strap is wearable by a user and configured to cooperate with the at least two static spaced apart bearings such that the motion subsystem is operable to travel along a portion of the second strap.

20 Claims, 9 Drawing Sheets

BEVERAGE CARRIER

CROSS-REFERENCE TO RELATED APPLICATIONS

This application claims priority to U.S. Provisional Patent Application No. 63/044,744, filed Jun. 26, 2020, the content of which is incorporated herein in its entirety by reference.

BACKGROUND

The present disclosure relates to a beverage holder and motion system for personal transport and use of beverages.

SUMMARY

A beverage carrier for personal transport of a contained beverage includes a beverage holder having a sleeve configured to support a beverage container and a splash guard coupled to the sleeve and positionable from a closed to an open position. A motion subsystem includes a motion block having a housing having a wall, at least two spaced apart static bearings protruding from the wall, and a strap extension protruding from the wall. A first strap is configured to couple the sleeve to the motion subsystem via the strap extension. A second strap is wearable by a user and configured to cooperate with the at least two static spaced apart bearings such that the motion subsystem is operable to travel along a portion of the second strap.

A motion block for a beverage carrier has a housing including a body having a wall and a cover spaced from the wall. At least one static bearing protrudes from the wall toward the cover. A slotted extension also protrudes from the wall toward the cover.

A beverage carrier for personal transport of a contained beverage includes a beverage holder and a motion block for supporting the beverage holder. The motion block includes a housing having a wall, a cover, and two spaced apart static bearings extending from the wall and configured to couple the cover to the housing. A strap is configured to cooperate with the two spaced apart static bearings such that when the beverage carrier is in use, the strap contacts nothing of the motion block other than the two spaced apart static bearings as the motion block travels along a portion of the strap.

Other features and aspects of the disclosure will become apparent by consideration of the following detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting.

DETAILED DESCRIPTION

FIGS. 1-10 illustrate a beverage carrier 10 that can be supported by and worn around the shoulder area, allowing a user to carry and store a beverage while having both hands free. This allows the user to perform tasks with both hands while maintaining easy access to the beverage. The beverage carrier 10 can be used during activities for which conventional beverage holders are often unusable or inaccessible and during activities in which for brief periods of time both hands are in use, to include occupational and recreational activities.

Figure 1:
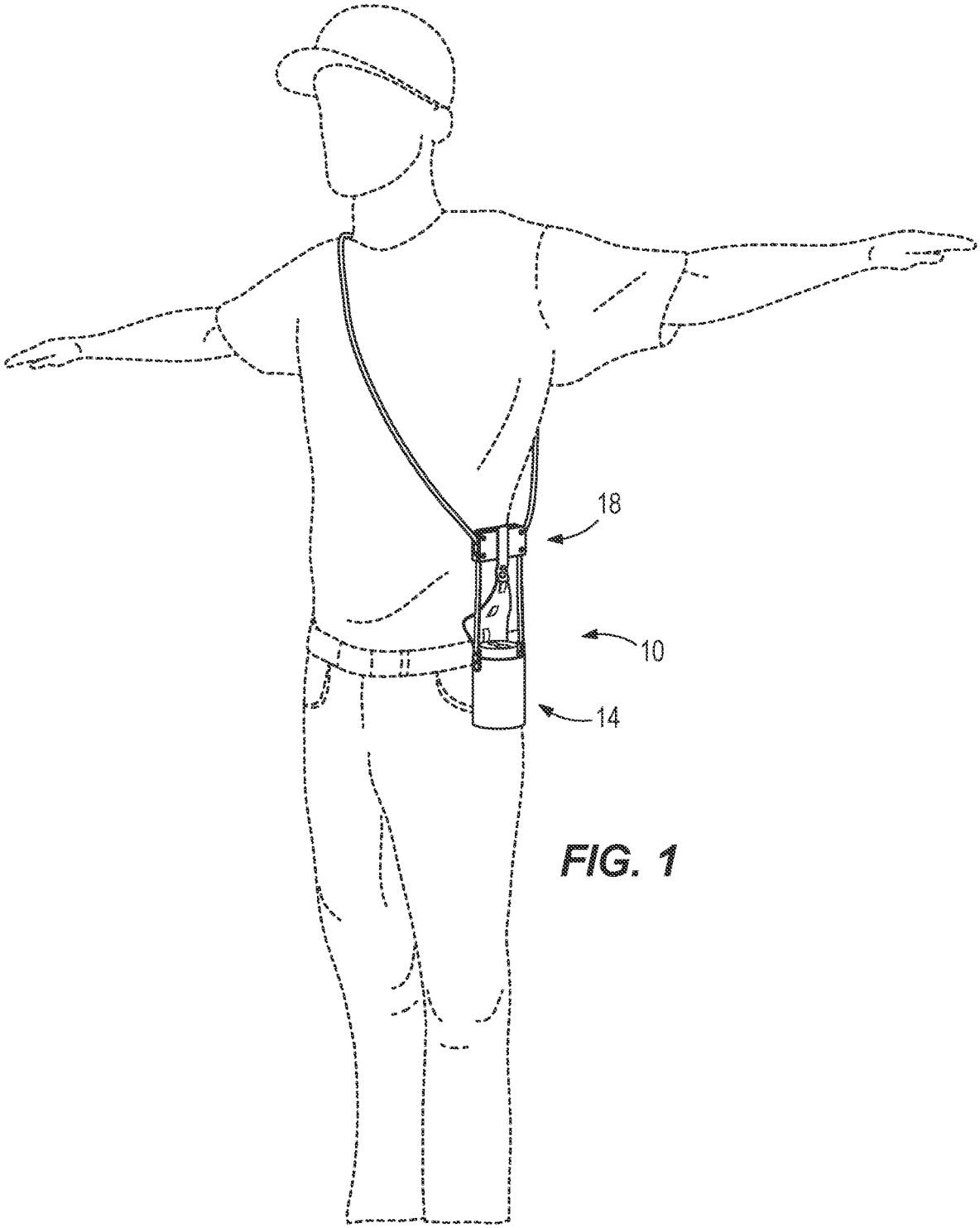
FIG. 1 is a perspective view of a beverage carrier in use.
Figure 2:
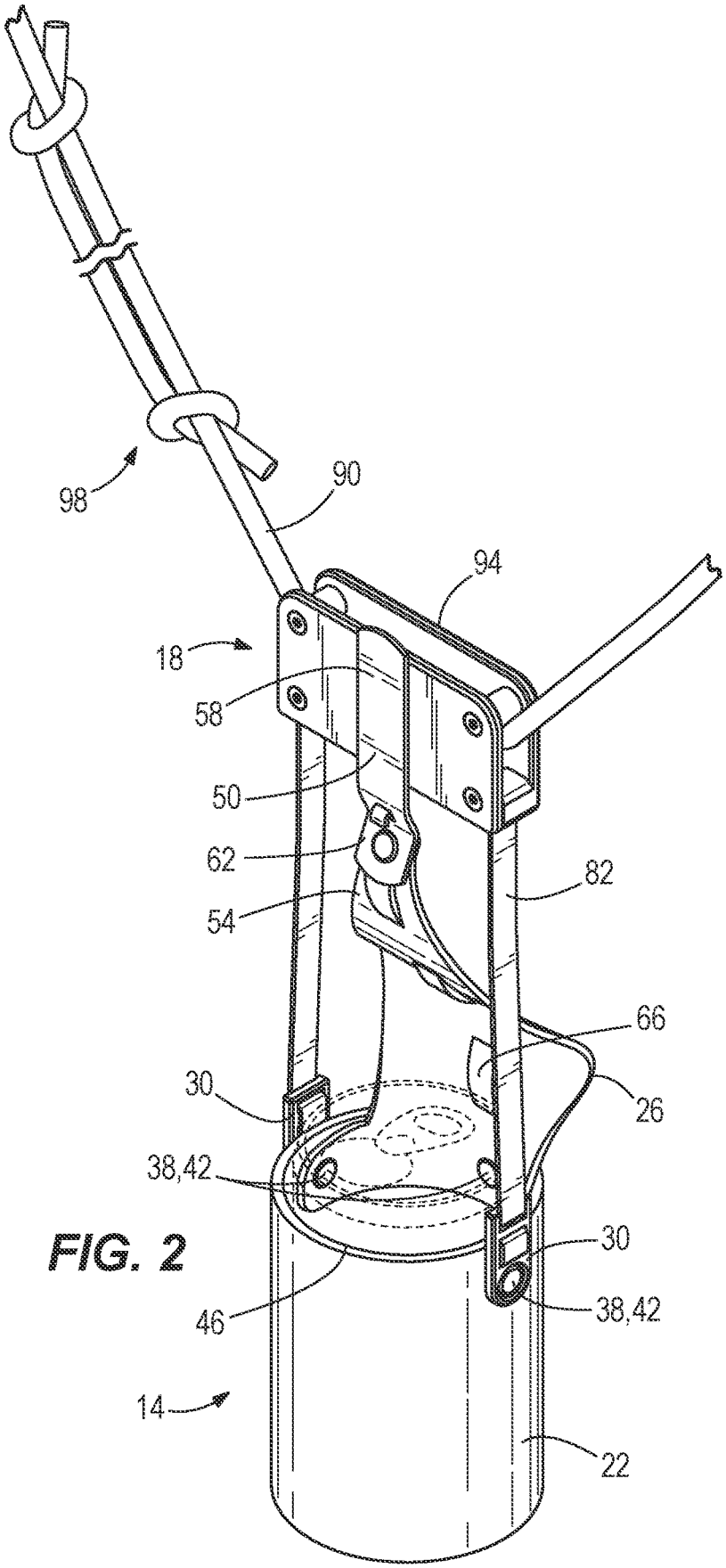
FIG. 2 is a front perspective view of the beverage carrier of FIG. 1 in a first configuration.
Figure 3:
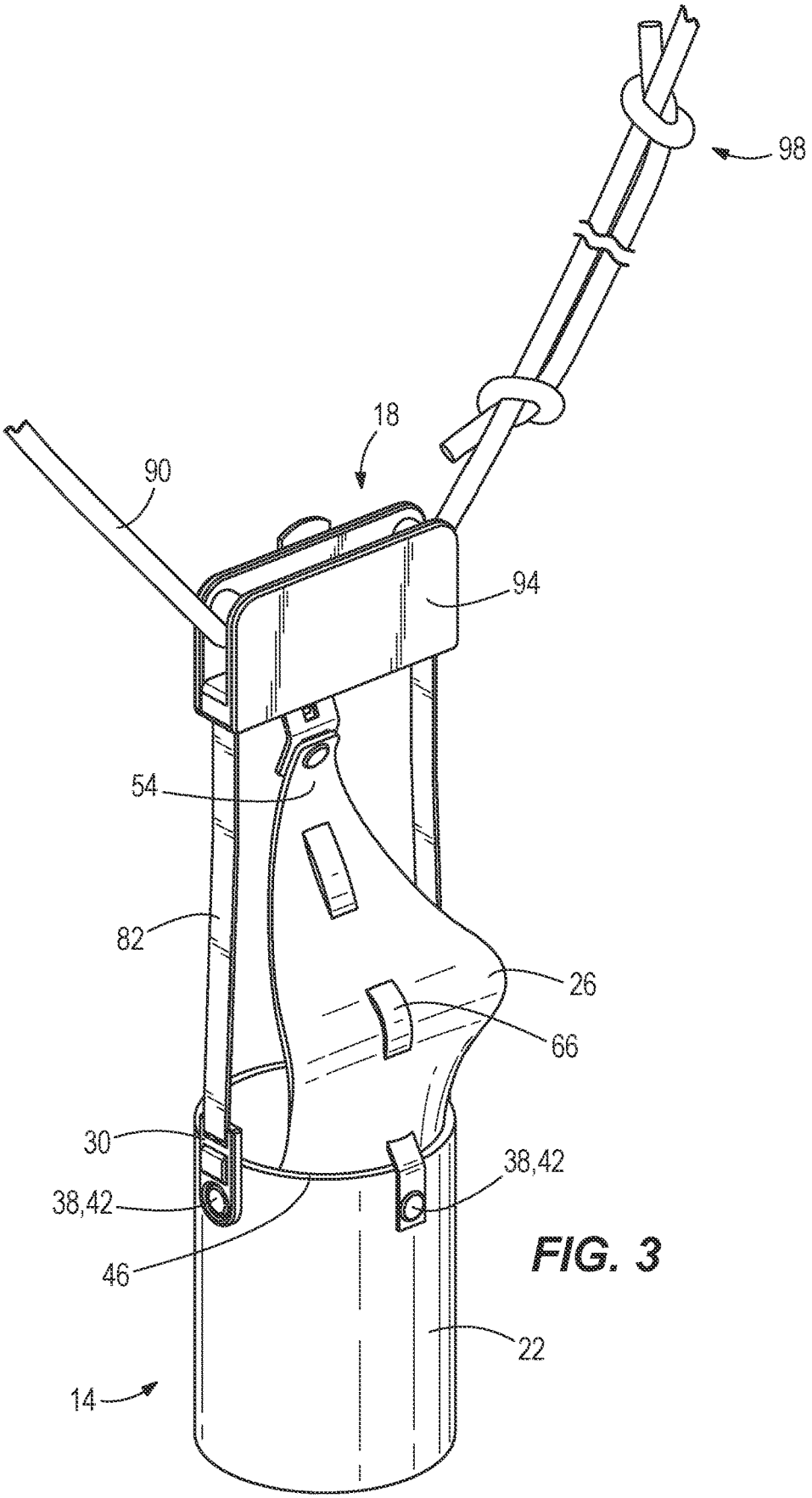
FIG. 3 is a rear perspective view of the beverage carrier of FIG. 2.

Referring to FIGS. 1-3, the beverage carrier 10 includes a beverage holder 14 and a motion or pulley system or subassembly 18.

Figure 4:
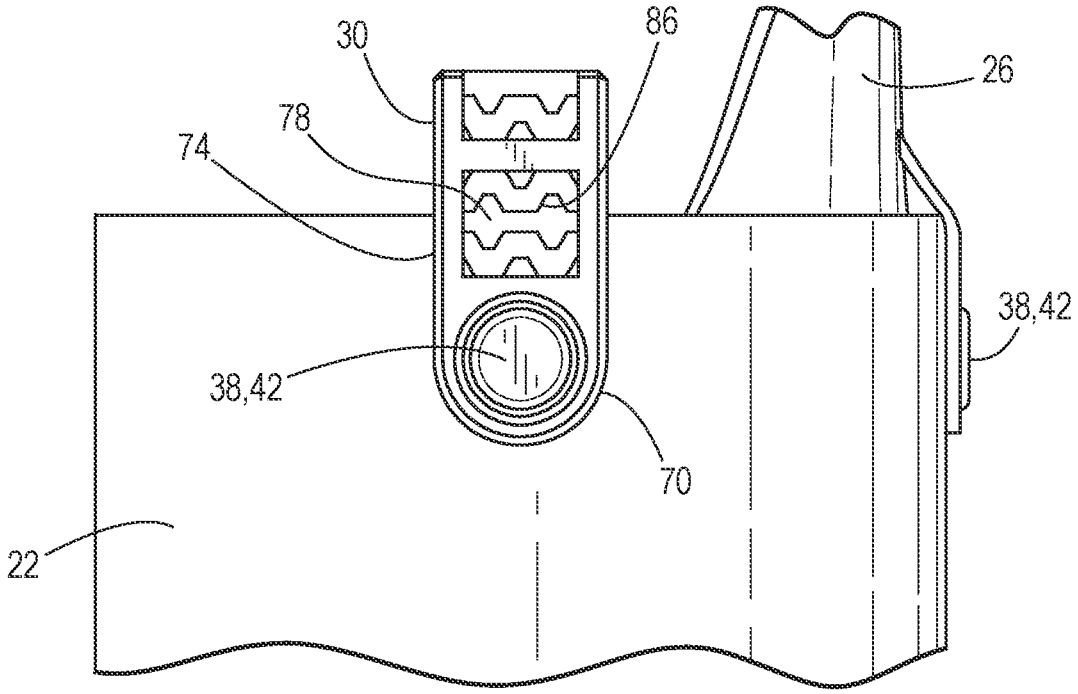
FIG. 4 is a partial side view of the beverage carrier of FIG. 2 with a strap removed.

Referring also to FIGS. 2-4, the beverage holder includes a sleeve 22, a splash guard 26, and a set of strap or webbing anchors 30. The sleeve 22 is a full bottom can sleeve that can hold a variety of beverage containers including, but not limited to, 12-oz cans, 16-oz cans, skinny cans, and 12-oz bottles in glass or plastic. The sleeve 22 is coupled to the splash guard 26 via a plurality of fasteners 38. The illustrated embodiment uses three rivets 42, though other forms and numbers of fastener can be used. The splash guard 26 extends above a rim 46 of the can sleeve 22 on a single side thereof. The splash guard 26 includes a positioning feature 50 located at a top or distal portion 54 of the splash guard 26 and partially formed with or from a magnetic material 58. In some embodiments the positioning feature 50 is also or additionally formed as a bottle opener 62. The positioning feature 50 is adjustable via a strap 66 that engages with the splash guard 26 for moving a relative position between the positioning feature 50 and the splash guard 26. The strap 66 weaves through apertures or slots in the splash guard 26 and connects to the can sleeve 22 with the splash guard 26 by at least one of the fasteners 38, 42 (see FIG. 3). Both the splash guard 26 and the sleeve 22 may be formed from neoprene or other durable material and may be self-insulating or include one or more layers of insulating material.

Referring further to FIG. 4, two of the fasteners 38, or rivets 42, located on opposing sides of the sleeve 22 also secure the webbing anchors 30 to the sleeve 22. The webbing anchors 30 each include a first end 70 connected to the sleeve 22 and a second end 74 presenting a set of slots 78 for adjustably and removably coupling with the pulley system 18 using a webbing strap 82, further detailed below. The slots 78 each include ridges 86 which create a friction interface for clamping the webbing strap 82.

In some embodiments, the beverage carrier 10 includes a set of beverage holders 14 configured with different colors, sizes, or shapes, which can therefore be interchanged as desired by uncoupling and recoupling the webbing anchors 30.

Figure 5:
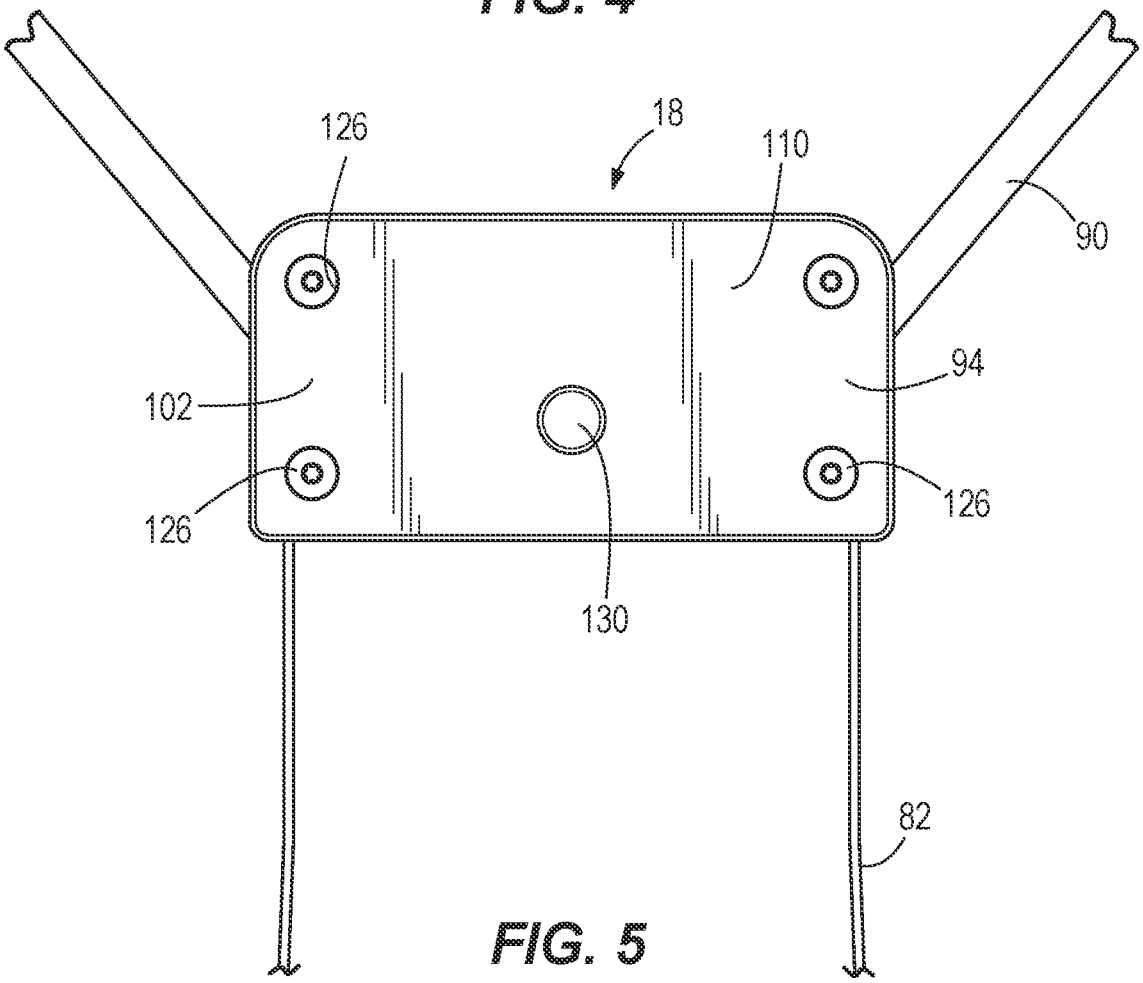
FIG. 5 is a front view of a motion system of the beverage carrier of FIG. 2.
Figure 6:
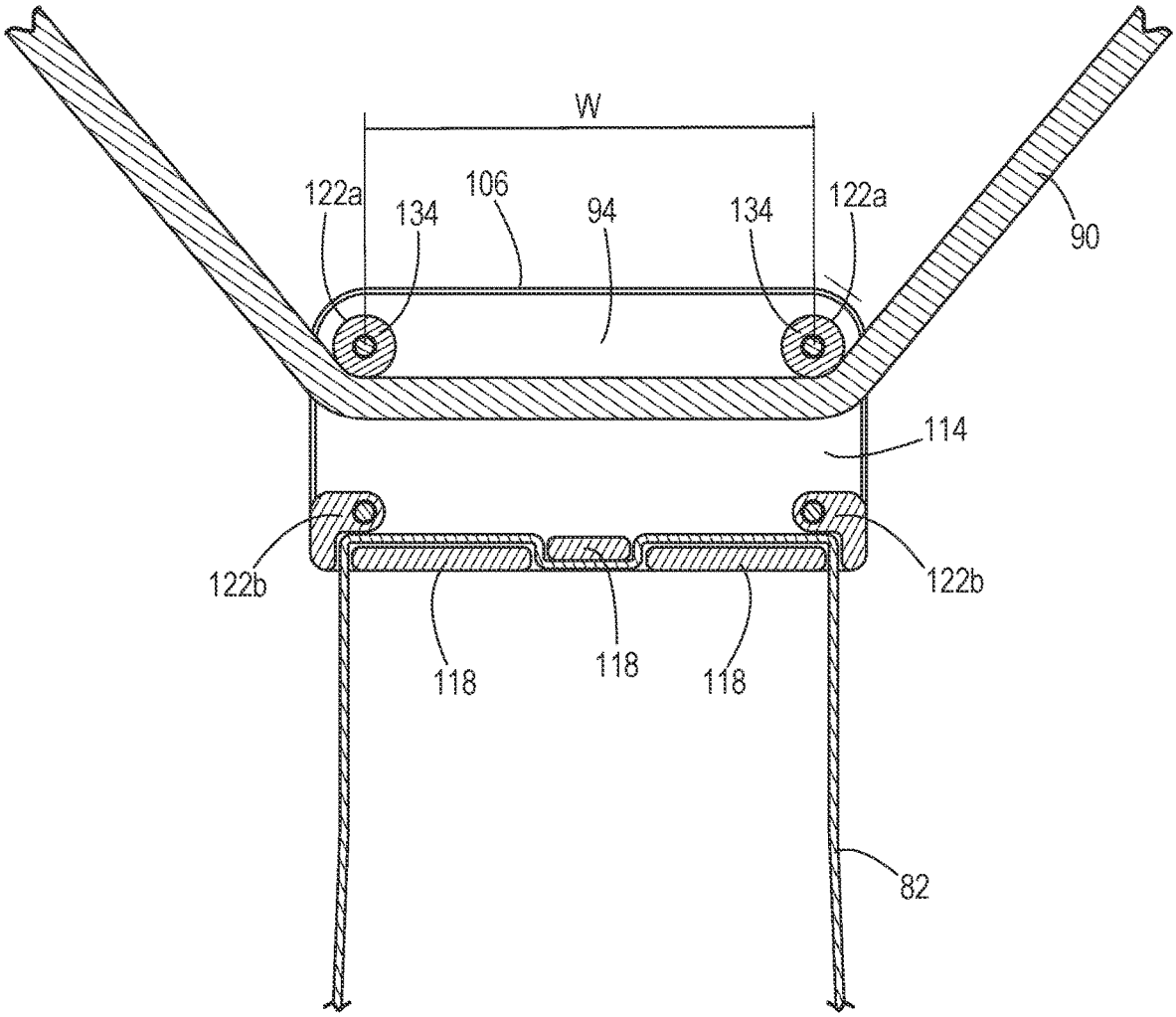
FIG. 6 is a front cross-sectional view of the motion system of FIG. 5.
Figure 7:
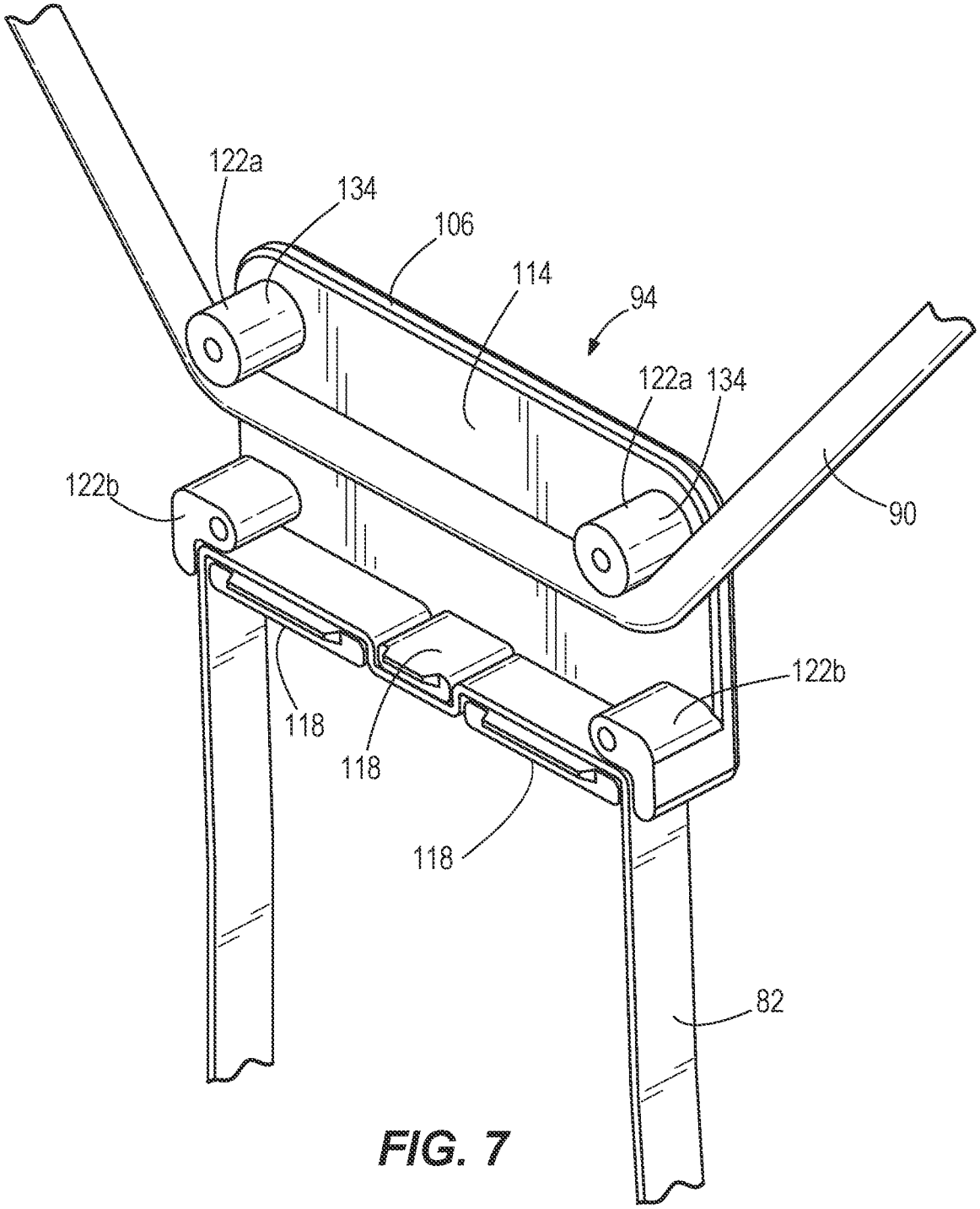
FIG. 7 is a perspective view of the motion system of FIG. 5 absent a portion of the cover.

Referring also to FIGS. 5-7, the motion system 18 includes a shoulder strap 90, a motion or pulley block 94, and the webbing strap 82. The shoulder strap 90 may be formed from a cord or rope, for example paracord. The size of the shoulder strap 90 is adjustable via an adjustment feature 98 (FIGS. 1, 2). In the illustrated embodiments, the adjustment feature 98 is in the form of a pair of slip knots. As the slip knots are moved closer to each other, the size of the shoulder strap 90 increases. As the slip knots are moved further apart, the size of the shoulder strap 90 decreases.

The pulley block 94 includes a housing 102 having a main body 106 and a cover 110. Both the main body 106 and the cover 110 may be constructed from a material such as stainless steel or corrosion resistant plastic. The cover 110 also includes a magnet 130 for cooperating with the magnetic material 58 of the positioning feature 50 of the splash guard 26.

The main body 106 includes a back wall 114, from which extends a set of strap extensions 118 and a set of screw bosses 122. The cover 110 includes a set of apertures 126 generally aligned with the screw bosses 122 for connection thereto. In the illustrated embodiment, the main body 106 includes four screw bosses 122. In other embodiments, the main body 106 may include more or fewer than four screw bosses 122. Two of the screw bosses 122*a* at corners opposite the strap extensions 118 are reinforced to act as static bearings 134 and form a "two-point" pulley configuration. The shoulder strap 90 extends through the pulley block 94 and slidably contacts the static bearings 134 such that the pulley block 94 provides two operable points of contact for the strap 90, further described below.

The static bearings 134 do not rotate, and in the illustrated embodiment the static bearings 134 have a circular profile. In other embodiments, however, the static bearings 134 may have a semi-circular profile, or any curvilinear profile formed to guide the pulley block 94 smoothly over the shoulder strap. In some embodiments, the static bearings 134 may have a triangular, rectangular, or square shaped profile. In yet other embodiments, rather than a pair of static bearings 134, one static bearing 134 may be used. The single static bearing may be, for example, obround in form and have a length comparable to the set width W described herein in relation to the pair of static bearings 134. Additionally, each static bearing may be referred to as a transition support, a sliding support, a fixed support, a fixed bearing, or a contact surface.

The webbing strap 82 interfaces with the strap extensions 118 and the screw bosses 122*b* and supports the beverage holder 14 below the pulley block 94. The webbing strap 82, constructed of nylon or another suitable material, is a single piece that extends from the pulley block 94 and connects to the webbing anchors 30. In the illustrated embodiment the slots 78 of the anchors include three slots 78. The webbing strap 82 weaves through the slots 78 in a serpentine manner and terminates at or near the end of the third slot 78. The webbing strap 82 is securely connected to the anchor 30 without requiring additional hardware to do so and can be installed such that no tail extends past the anchor 30. The webbing strap 82 is therefore less likely to tangle or catch on the surrounding environment. In other embodiments, the webbing strap connects to the webbing anchors in a manner that permits adjustability of the spacing between the pulley block 94 and the beverage holder 14.

Figure 8B:
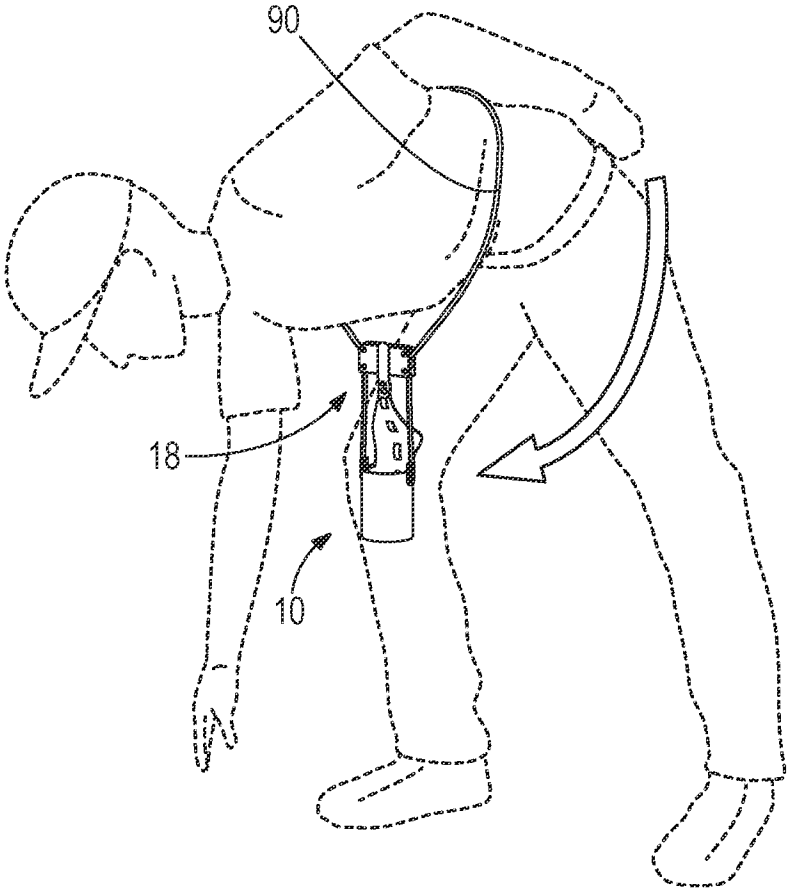
FIG. 8B illustrates the user of FIG. 8A using the beverage carrier of FIG. 1 in a second position.
Figure 8A:
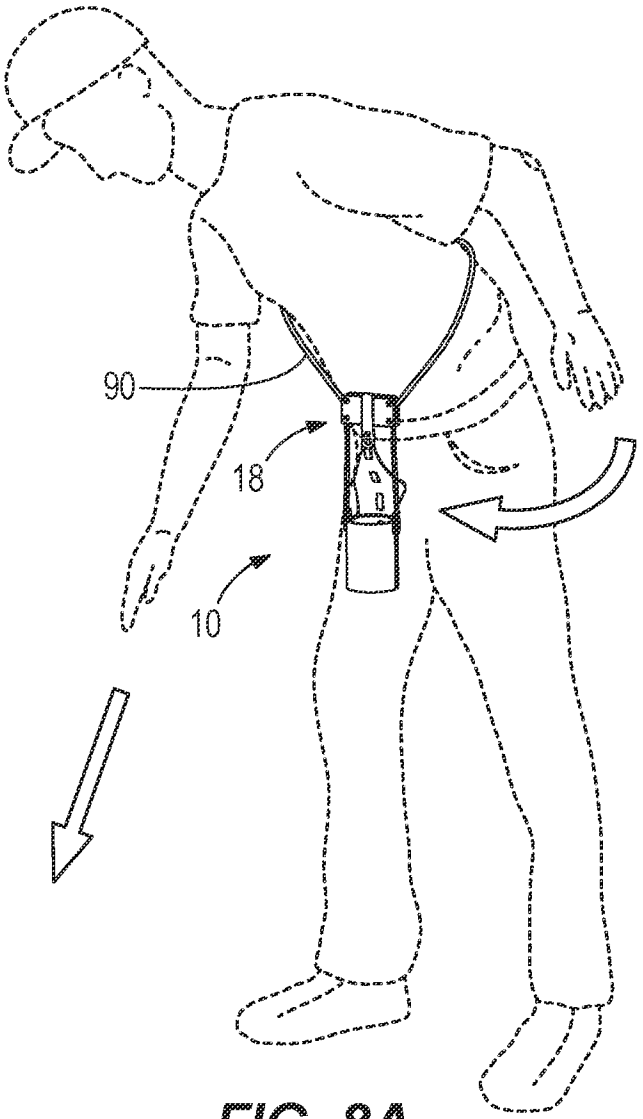
FIG. 8A illustrates a user using the beverage carrier of FIG. 1 in a first position.

In use, the pulley system 18 allows the beverage holder 14 to move freely, typically in a non-rotational manner, along at least a portion of the shoulder strap 90. The movement of the pulley block 94 along the shoulder strap 90 therefore keeps the beverage holder 14 generally upright or aligned relative to gravity regardless of the position of the user to decrease the risk of spillage of the contents within the holder 14. For example, as shown in FIGS. 8A and 8B, if the user bends over, the system 18 will permit shifting of the beverage holder 14 accordingly while maintaining the beverage holder 14 in a stable upright position (see FIG. 8B) without requiring the user to separately manipulate the beverage.

In particular, the "two-point" contact or pair of static bearings 134 illustrated allows the housing 102 to move along the shoulder strap 90 but also facilitates damping during movement such that the beverage holder 14 moves at a slower speed and slows or stops in a gentle manner, reducing the incidence of spills and also carbonation loss. In some embodiments, one static bearing 134 may be used to achieve this motion, or three or more static bearings 134 may be used.

The neoprene construction of the beverage holder 14 itself tends to roll, rather than slide, the beverage holder 14 along the user's person. Using the static bearings 134 as herein disclosed hinders or impedes the beverage holder 14 from such rotation during operation of the beverage carrier 10. Specifically, the width W between each static bearing 134 (the linear center-to-center distance, i.e., a "two-point" bearing set) reduces or prevents such rolling (whether friction or gravity induced), limits unnecessary beverage movement, and promotes correct splash guard 26 orientation. In some embodiments, the set width W may be between 2 inches and 4 inches. In some embodiments, the set width W may be approximately 2.3 inches, which generally corresponds to the width of a standard 12-oz beverage can.

Figure 9B:
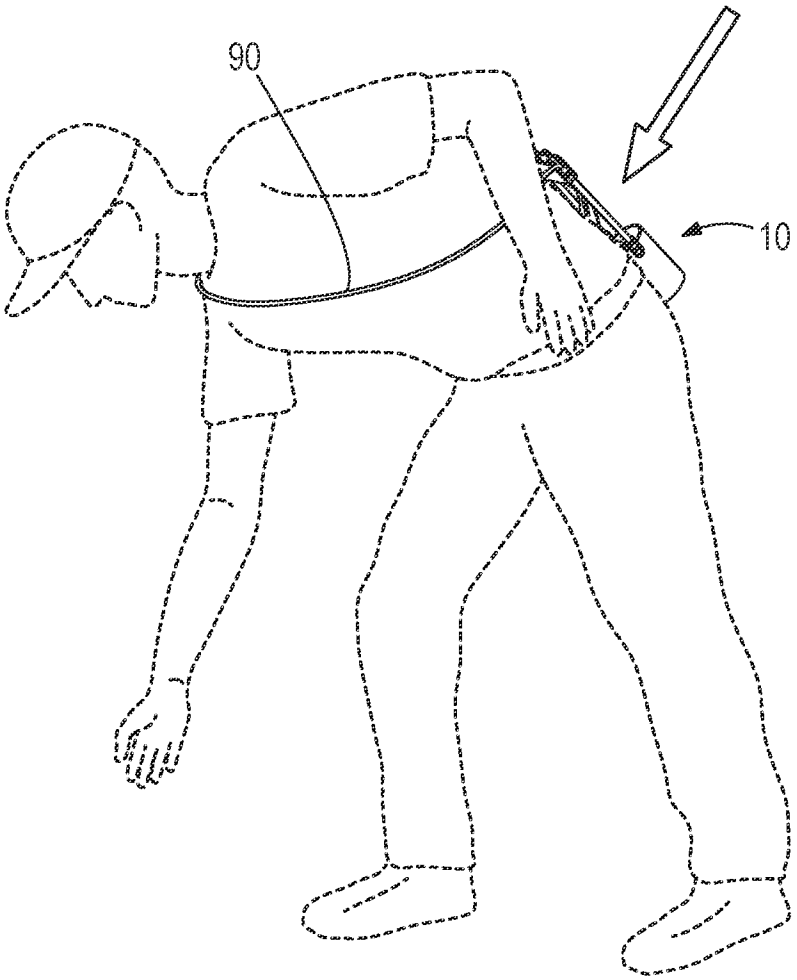
FIG. 9B illustrates the user of FIG. 9A using the beverage carrier of FIG. 1 in a third position.
Figure 9A:
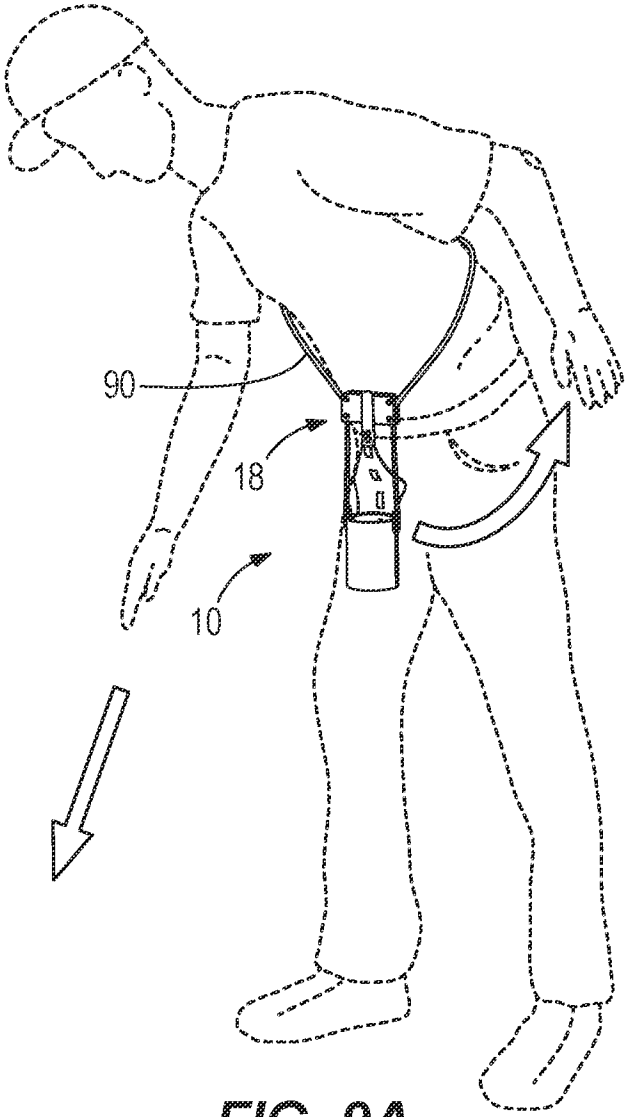
FIG. 9A illustrates a user using the beverage carrier of FIG. 1 in the first position.

As shown in FIGS. 9A and 9B, if the user bends over (FIG. 9A), the system 18 can alternatively be shifted to the back of the body (see FIG. 9B) without spillage. To do so, the user would position the beverage holder around to a location at or on the user's back before or as bending forward. In the position shown in FIG. 9B, the beverage holder is inclined and rests on the user's back, where it will tend to stay. If the beverage holder were to abruptly move, the pulley block 92 would slide along the strap 90 and the system 18 would stabilize the beverage holder 14 such that no spillage of the beverage occurs.

As discussed herein, in the illustrated embodiment no freely rotating bearings or similar members are used with the pulley system 18. This reduces manufacturing cost while also improving performance, as described.

Figure 10:
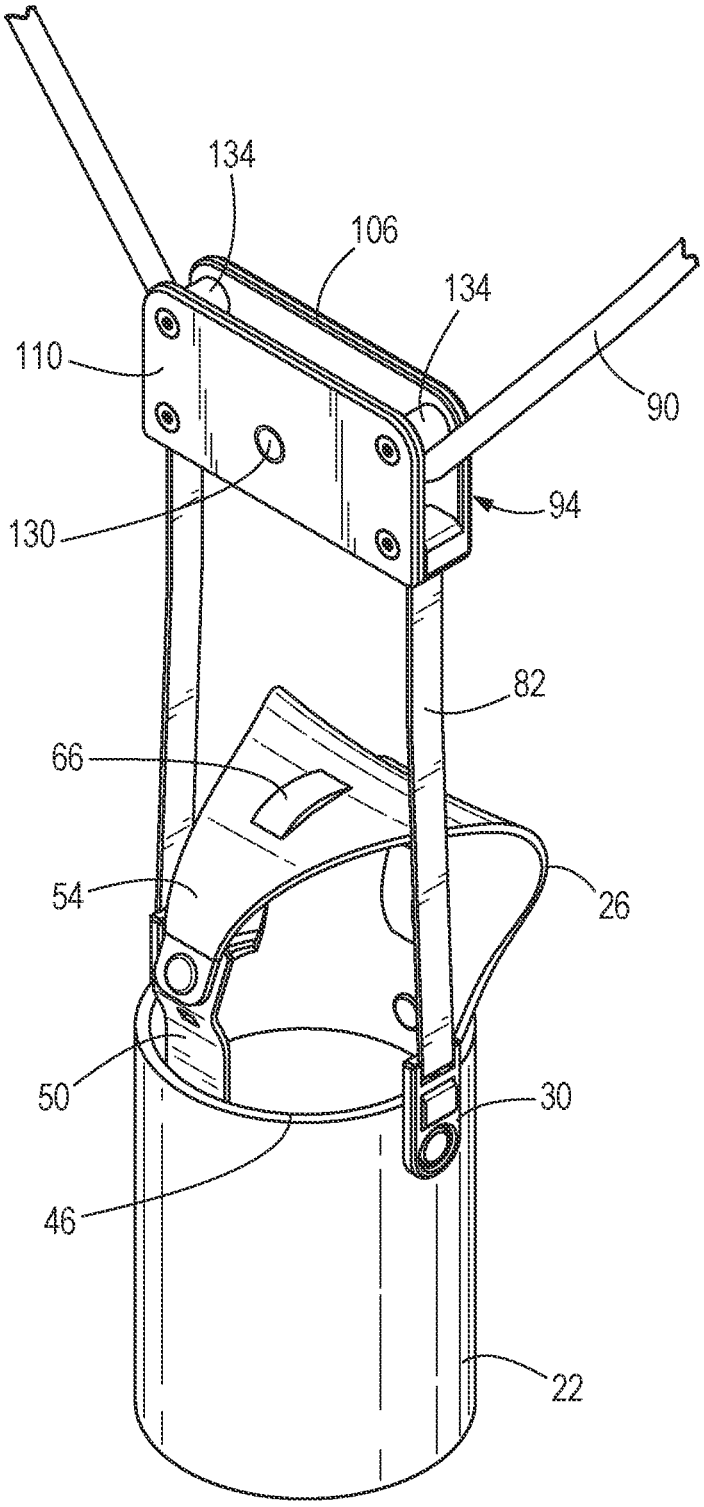
FIG. 10 is a front perspective view of the beverage carrier of FIG. 1 in a second configuration.

Referring to FIGS. 2-3 and 10, the beverage carrier transitions between a first mode, or operational mode (FIGS. 2-3), and a second mode, or transport mode (FIG. 10). In the first mode, the magnet 130 on the pulley block 94 magnetically retains the positioning feature 50 adjacent the pulley block 94, supporting the splash guard 26 in a generally vertical or upright position extending away from the sleeve 22. The first mode allows the beverage container to be accessed easily, while also positioning the splash guard 26 between the beverage container and the user, such that any stray liquid is less likely to directly contact the user. In the second mode, the positioning feature 50 is removed from the magnet 130 and tucked between the beverage container and the sleeve 22, supporting the splash guard 26 over the top of the beverage container (in other embodiments the sleeve 22 and positioning feature 50 may include a separate fastening system. e.g., hook-and-loop fasteners, or a cooperative magnet on the sleeve 22). The second mode allows the user to participate in more active movements with minimal risk of spilling the liquid from the beverage container.

In any particular embodiment, the use of the term "strap" is meant to broadly encompass variations in any type of strap, webbing, cord, rope, tie, band, belt, or similar form with similar functional characteristics. Further, all features of the beverage carrier are applicable and operable with static bearings of any form described herein, whether as a single static bearing, a pair of static bearings, or more than two static bearings.

While the above describes example embodiments of the present disclosure, these descriptions should not be viewed in a limiting sense. Rather, several variations and modifications can be made without departing from the scope of the present disclosure.

What is claimed is:

1. A beverage carrier for personal transport of a contained beverage, the beverage carrier comprising:

a beverage holder including a sleeve configured to support a beverage container and a splash guard coupled to the sleeve and positionable from a closed to an open position;

a motion subsystem having a motion block including a housing having a wall, at least two spaced apart static bearings protruding from the wall, and a strap extension protruding from the wall;

a first strap configured to couple the sleeve to the motion subsystem via the strap extension; and a second strap wearable by a user and configured to cooperate with the at least two static spaced apart bearings such that the motion subsystem is operable to travel along a portion of the second strap.

2. The beverage carrier of claim 1, wherein the housing includes a fastener configured to retain the splash guard in the open position.

3. The beverage carrier of claim 2, wherein the fastener is in the form of a magnet.

4. The beverage carrier of claim 1, wherein the sleeve includes a fastener configured to retain the splash guard in the closed position.

5. The beverage carrier of claim 2, wherein the splash guard is configured to function as a bottle opener.

6. The beverage carrier of claim 1, further including a cover for the housing, and wherein at least one of the at least two spaced apart static bearings is configured to secure the cover to the housing.

7. The beverage carrier of claim 1, further including a cover for the housing, and wherein the strap extension is a slotted strap extension presenting a tortuous path for the first strap within the motion block.

8. The beverage carrier of claim 7, further including first and second screw bosses configured to secure the cover to the housing and to cooperate with the slotted strap extension to present the tortuous path for the first strap.

9. The beverage carrier of claim 7, further including first and second screw bosses configured to secure the cover to the housing and to guide the first strap within the motion block.

10. The beverage carrier of claim 1, wherein the beverage carrier is configured such that when in use, the second strap contacts nothing of the motion subsystem other than the at least two spaced apart static bearings.

11. The beverage carrier of claim 10, wherein the beverage carrier is configured such that when in use, the second strap slidably contacts the at least two spaced apart static bearings.

12. The beverage carrier of claim 1, wherein the at least two spaced apart static bearings comprise two static bearings, and wherein the center-to-center distance between the two static bearings is between two and four inches.

13. A motion block for a beverage carrier, the motion block comprising:

a housing including a body having a wall;

a cover spaced from the wall;

at least one static bearing protruding from the wall toward the cover; and a slotted extension protruding from the wall toward the cover.

14. The motion block of claim 13, wherein the at least one static bearing is integrally formed as one piece with the wall.

15. The motion block of claim 13, wherein the slotted extension is integrally formed as one piece with the wall.

16. The beverage carrier of claim 13, wherein the at least one static bearing is configured to secure the cover to the housing.

17. The beverage carrier of claim 13, wherein the at least one static bearing is an obround-shaped static bearing.

18. A beverage carrier for personal transport of a contained beverage, the beverage carrier comprising:

a beverage holder;

a motion block for supporting the beverage holder, the motion block including a housing having a wall, a cover, and two spaced apart static bearings extending from the wall and configured to couple the cover to the housing; and a strap configured to cooperate with the two spaced apart static bearings such that when the beverage carrier is in use, the strap contacts nothing of the motion block other than the two spaced apart static bearings as the motion block travels along a portion of the strap.

19. The beverage carrier of claim 16, wherein the beverage carrier is configured such that when in use, the strap slidably contacts the two spaced apart static bearings.

20. The beverage carrier of claim 16, wherein the beverage carrier is configured such that when in use, the portion of the strap is parallel to the linear distance between the two spaced apart static bearings.

* * * * *